US007435113B2

(12) United States Patent
Cheng et al.

(10) Patent No.: US 7,435,113 B2
(45) Date of Patent: Oct. 14, 2008

(54) ELECTRIC CONNECTOR

(75) Inventors: Yong Terng Cheng, Singapore (SG); Chee Boon Vincent Lim, Singapore (SG); Akira Nagamine, Aichi (JP)

(73) Assignees: J.S.T. Mfg. Co., Ltd., Osaka (JP); MEA Technologies Pte. Ltd., Singapore (SG)

( * ) Notice: Subject to any disclaimer, the term of this patent is extended or adjusted under 35 U.S.C. 154(b) by 0 days.

(21) Appl. No.: 11/716,859

(22) Filed: Mar. 12, 2007

(65) Prior Publication Data

US 2007/0218729 A1 Sep. 20, 2007

(30) Foreign Application Priority Data

Mar. 17, 2006 (SG) ..... 200601775-0

(51) Int. Cl.
*H01R 13/62* (2006.01)

(52) U.S. Cl. ..... 439/157

(58) Field of Classification Search ..... 439/157, 439/160, 488, 489, 347, 372, 701, 152, 155
See application file for complete search history.

(56) References Cited

U.S. PATENT DOCUMENTS 5,172,998 A * 12/1992 Hatagishi ..... 403/27
5,833,484 A 11/1998 Post et al.
6,247,966 B1 6/2001 Klein et al.
6,373,713 B1 * 4/2002 Jensen et al. ..... 361/759
6,944,029 B1 * 9/2005 Marcolina et al. ..... 361/754
2005/0106911 A1 * 5/2005 Sharples et al. ..... 439/157
2006/0051993 A1 * 3/2006 Dillon et al. ..... 439/157

FOREIGN PATENT DOCUMENTS

DE 8714016 10/1987

* cited by examiner

*Primary Examiner*—Tulsidas C. Patel
*Assistant Examiner*—Vladimir Imas
(74) *Attorney, Agent, or Firm*—Osha - Liang LLP

(57) ABSTRACT

An electric connector includes a connector body 2 having contacts, and a connector housing 10. The connector housing 10 has a cavity 12, for housing the connector body 2, and an operation lever 16. The connector body 2 is inserted into the cavity 12, and the electric connector is engaged with another connector by rotating the operation lever 16. The connector housing 10 has a sensing member 13 on one of its sidewalls. The sensing member 13 resiliently changes its shape according to insertion conditions of the connector body 2, either rising from the sidewall or flat on the sidewall. The sensing member 13 detects the insertion conditions of the connector body 2 in the cavity 12. The operation lever 16 hits the sensing member 13 when the sensing member rises from the sidewall, and rotation of the operation lever 16 is blocked. With this configuration, connection between the connector body 2 having the contacts and the connector housing 10 that houses the connector body 2 is properly made. Thus, the electric connector having improved reliability and safety in the connection with the other connector is provided.

4 Claims, 7 Drawing Sheets

Fig.3
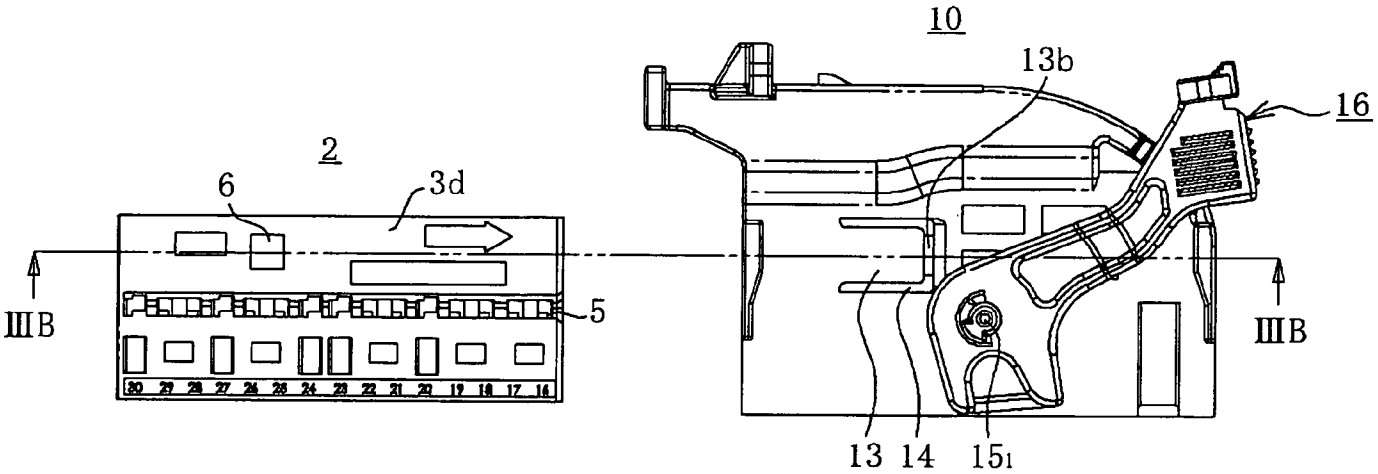
Fig. 3A
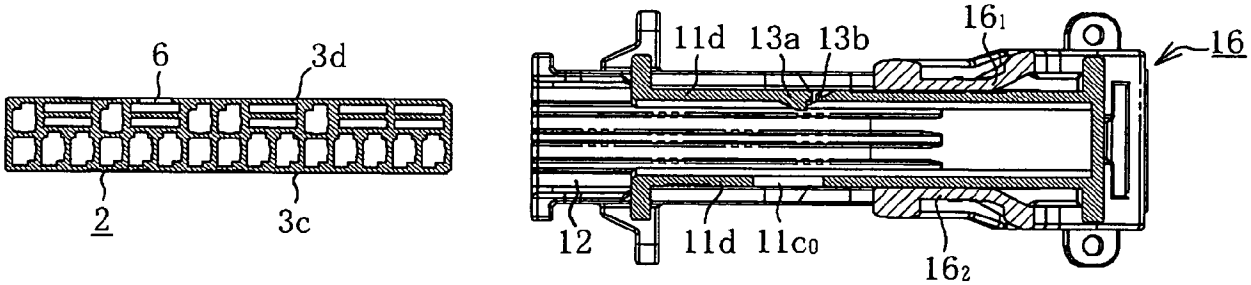
Fig. 3B

Fig.4
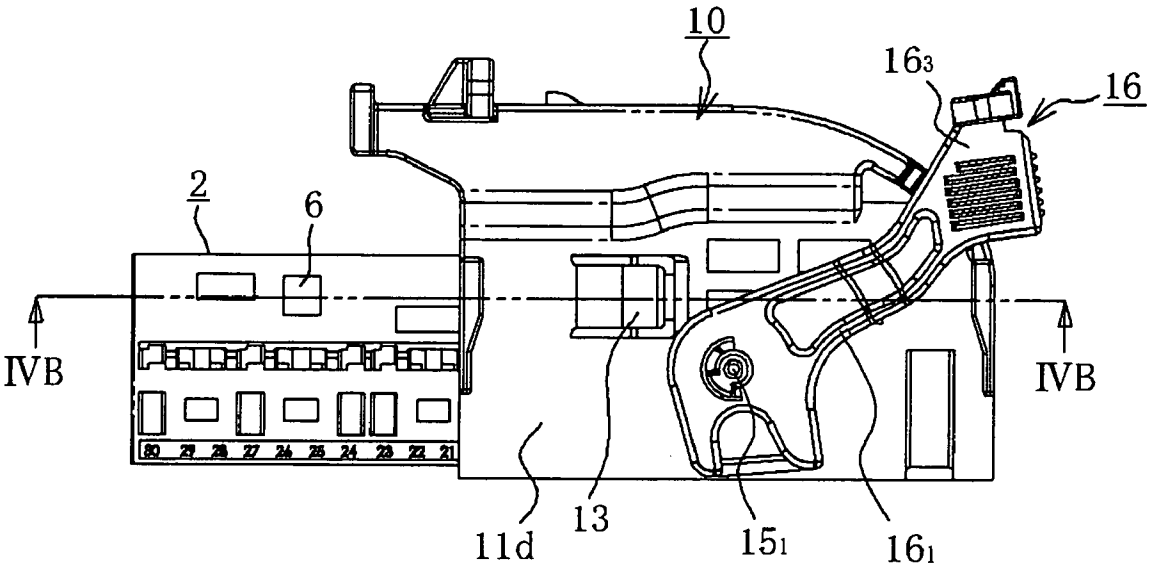
Fig. 4A
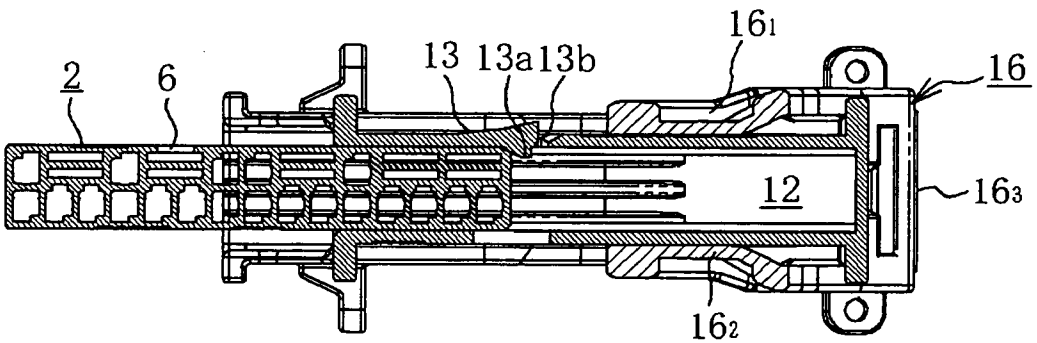
Fig. 4B

Fig.5
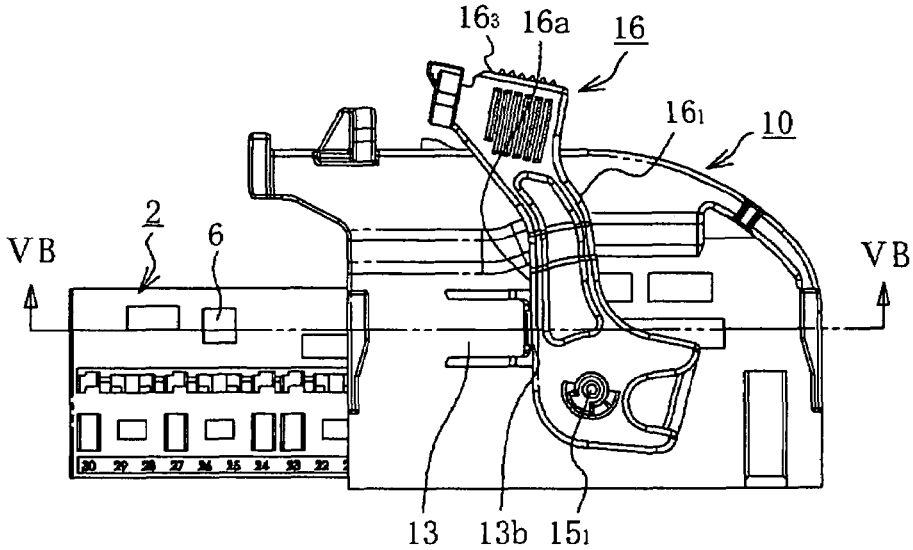
Fig. 5A
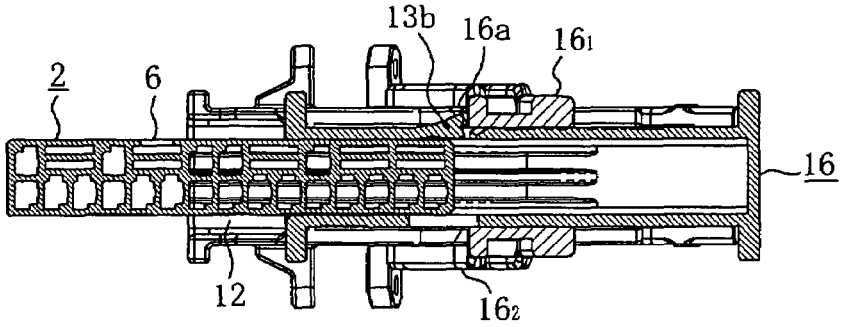
Fig. 5B
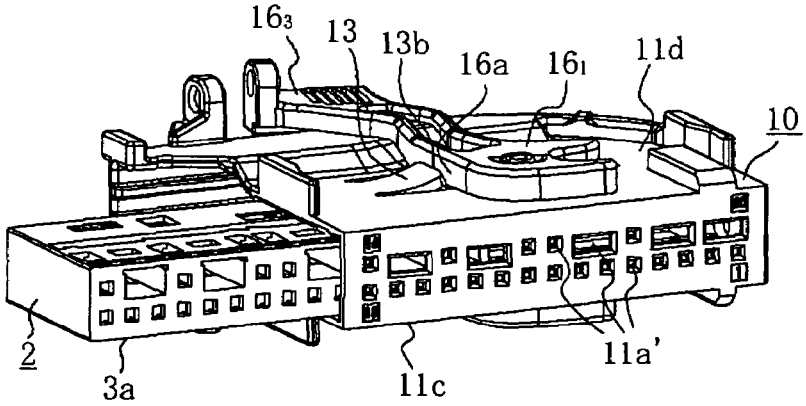
Fig. 5C

ELECTRIC CONNECTOR

FIELD OF THE INVENTION

This invention relates to an electric connector having a lock function for locking a connection between the electric connector and another connector by rotating an operation lever.

BACKGROUND OF THE INVENTION

Electric connector assemblies in which a pair of connectors is locked by using a lock mechanism having a rack and a pinion have been introduced in many patent documents. For example, an electric connector assembly 20 described in the specification of German Utility Model No. 8714016 is shown in FIG. 6. The electric connector assembly 20 has the first and the second connectors 21, 22 that are engaged with each other. The second connector 22 has an operation lever 23 having a pinion 23*a* in its housing. The operation lever 23 is rotatably connected to the housing with a shaft. The first connector 21 has a structure in which a rack 21*a* is formed in a cavity of its housing.

The connectors 21, 22 are engaged with each other by the following procedures. First, the second connector 22 is inserted into the cavity of the first connector 21, and the rack 21*a* and the pinion 23*a* are engaged with each other. When the operation lever 23 is rotated, the second connector 22 is fully engaged with the first connector 21 inside the cavity 21*b* of the first connector 21. The connectors 21, 22, are released from each other by rotating the operation lever 23 in the opposite direction. The pair of connectors 21, 22 is anchored by engaging the operation lever 23 at a closed position with a latch, namely, making latch engagement at an end of rotation position. With this configuration, the engagement between the connectors can be quickly performed by only inserting into the other connector and making snap engagement between the connectors. Lever-type electric connector assemblies having the same type of operation levers are introduced in U.S. Pat. Nos. 5,833,484 and 6247966B1.

The electric connector assembly described in the specification of U.S. Pat. No. 6,247,966B1 is constructed from a pair of connectors. As shown in FIG. 7, the first connector 25 has a connector body 26 having contacts, and a housing 27 having a cavity 27*a* and an operation lever 28. The size of the cavity 27*a* is decided so as to be capable of housing the connector body 26. The connector body 26 is housed in the cavity 27*a* of the housing 27. When the connector body 26 is inserted in the cavity 27*a* of the housing 27, a locking projection part 26*a* formed on a sidewall of the connector body 26 is engaged with a catching part 27*b* formed in the housing 27 via snap engagement.

With the above-described configurations, engagement of a pair of connector assemblies is properly made and secured with the operation lever, which reduces accidental release of the engagement. For this reason, these connectors are used in airbag systems of vehicles that require special emphasis on safety and reliability.

In these electric connector assemblies, however, a receptacle of a receptacle-type connector may be engaged with another connector in a condition that the receptacle is not properly housed in a cavity of a connector housing when the receptacle is inserted into the housing. If an operation lever is rotated in the condition that the receptacle is not properly housed in the connector housing, contacts mounted to the receptacle are not properly connected with contacts of the other connector. As a result, abnormal stress may be applied to the contacts and the contacts may be damaged. In connector assemblies in which a connector housing and a receptacle are engaged via snap engagement, such as the connector of U.S. Pat. No. 6,247,966B1, whether the receptacle is properly hosed in the connector housing cannot be confirmed. Moreover, this type of connector is expected to have more emphasis on safety and reliability. If the connector housing and the receptacle are not properly engaged, safety level may be reduced.

SUMMARY

In consideration of the above-described related art, the present invention is developed for enhancing safety and improving reliability. An objective of the present invention is to provide an electric connector in which connection between a connector body including a contact and a connector housing that houses the connector body is more secure in comparison with related art. Namely, the present invention provides an electric connector having improved reliability and safety.

Another objective of the present invention is to provide an electric connector that enables achievement of the above objective with simple configurations.

To achieve the above objectives, an electric connector of claim 1 of this application has the following configurations and features. The electric connector has a connector body having a contact and a connector housing having a cavity, for housing the connector body, and an operation lever. The connector body is slid into the cavity of the connector housing, and the operation lever is rotated for engagement with another connector.

The connector housing has a sensing member that is formed in one of sidewalls for detecting an insertion condition of the connector body in the cavity by rising from the sidewall as the connector body is slid into the cavity. The operation lever hits the sensing member when the sensing member rises from the sidewall, and therefore, rotation of the operation lever is blocked.

According to an electric connector of claim 2, the sensing member of the electric connector of claim 1 has a resilient piece, a projection, and a well. The resilient piece is formed by cutting away a portion of the sidewall of the connector housing. The projection is formed on an inner surface of a free end of the resilient piece such that the projection extends inwardly in the cavity. The well is formed in a portion of a sidewall of the connector body such that the projection is fitted in. The projection is fitted in the well when the connector body is completely inserted in the cavity of the connector housing.

According to an electric connector of claim 3, the operation lever of the electric connector of claims 1 and 2 has a predetermined length of an arm member, and the arm member hits the sensing member.

According to an electric connector of claim 4, the operation lever of the electric connector of claim 3 has an engagement portion at one end of the arm member. The engagement portion is to be engaged with the other connector.

With the above configurations, the present invention provides the following effects. According to the invention of claim 1, the rotation of the operation lever is blocked when the sensing member rises from the sidewall of the connector housing. Namely, an engagement with the other connector cannot be made in a condition that the connector body is not completely inserted in the connector housing. Thus, the reliability and the safety of the connector connection are improved.

According to the invention of claim 2, the resilient piece of the sensing member is formed by cutting away a portion of the sidewall of the connector housing. Namely, the sensing member is easily formed because an extra part and an assembly process are not required. Moreover, only the well is formed in the sidewall of the connector body. Therefore, the connector body also can be easily formed.

According to the invention of claim 3, the arm member of the operation lever hits the sensing member. Thus, an incomplete condition of the insertion condition of the connector body in the connector housing is detected with a simple configuration.

According to the invention of claim 4, the engagement portion that is engaged with the other connector is formed at one end of the lever member. The engagement portion may be a pinion that is interlocked with a rack of the other connector. With this configuration, the connector is connected with the other connector only in a condition that the connector body is completely inserted in the connector housing. Therefore, the reliability and the safety of the connection with the other connector are improved.

BRIEF DESCRIPTION OF THE DRAWINGS

FIG. 3A is a side view of the electric connector of FIG. 1 viewed from a different angle;

FIG. 3B is a cross-sectional view of the electric connector sectioned by the IIIB-IIIB line of FIG. 3A;

FIG. 4A is a side view of the electric connector in a condition that the connector body is partially inserted in the housing;

FIG. 4B is a cross-sectional view of the electric connector sectioned by the IVB-IVB line of FIG. 4A;

FIG. 5A is a side view of the electric connector in a condition that the connector body is incompletely inserted in the housing;

FIG. 5B is a cross-sectional view of the electric connector sectioned by the VB-VB line of FIG. 5A;

FIG. 5C is a perspective view of the electric connector of FIG. 5A viewed from a different angle;

DETAILED DESCRIPTION OF THE PREFERRED EMBODIMENT

Figure 1:
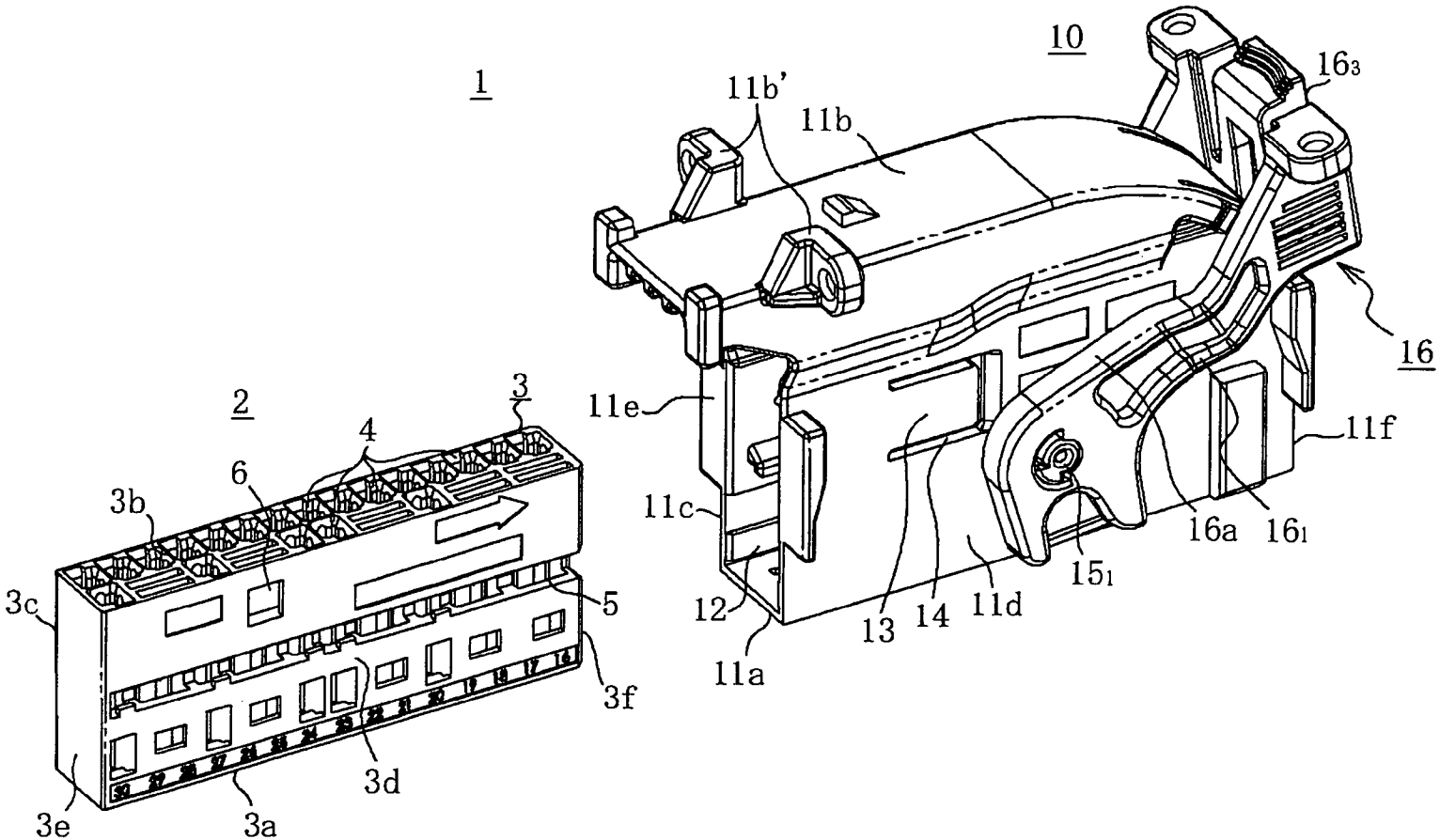
FIG. 1 is an exploded perspective view of an electric connector according to an embodiment of the present invention.
Figure 2:
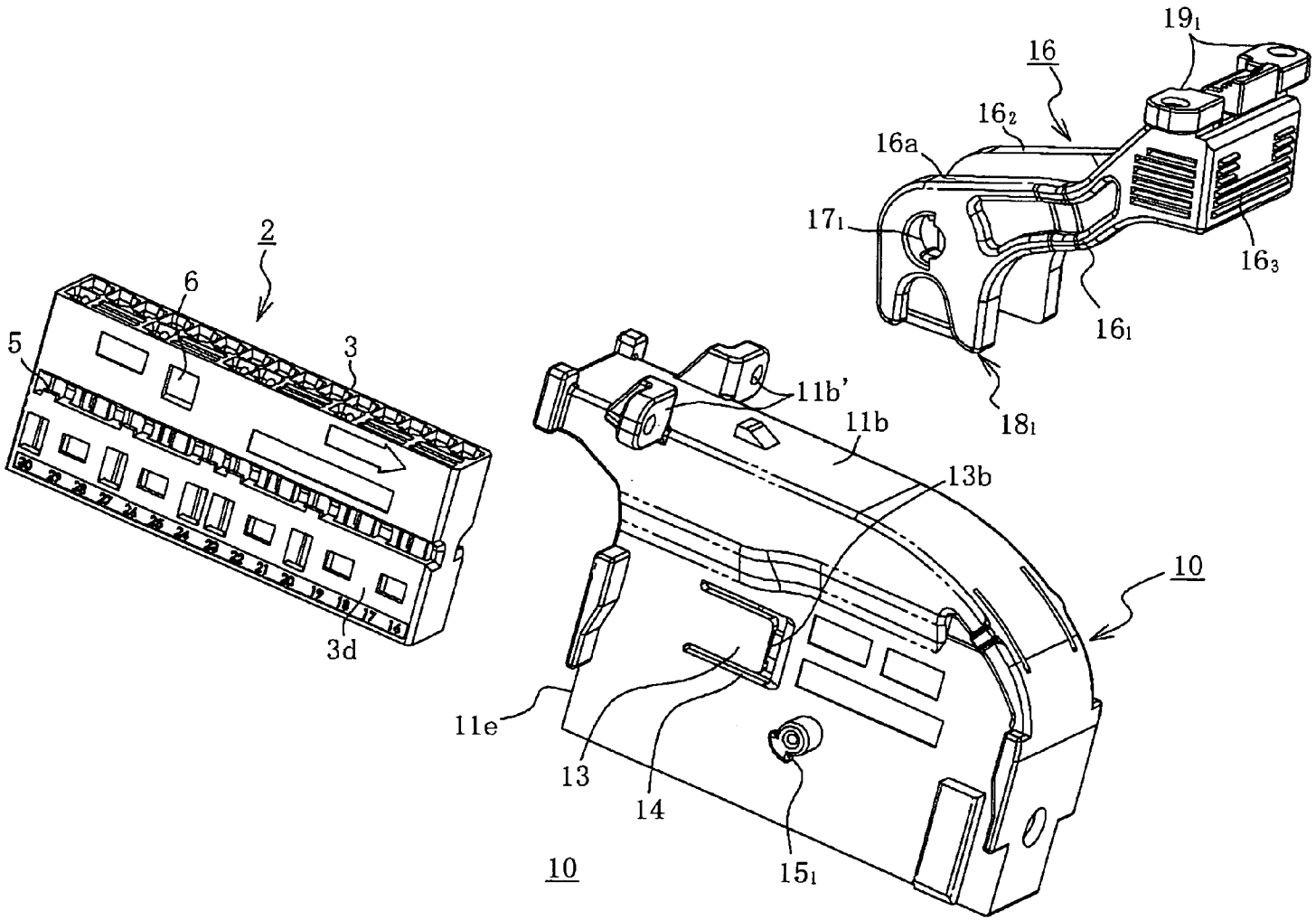
FIG. 2 is an exploded perspective view of the electric connector of FIG. 1 without an operation lever.
Figure 6:
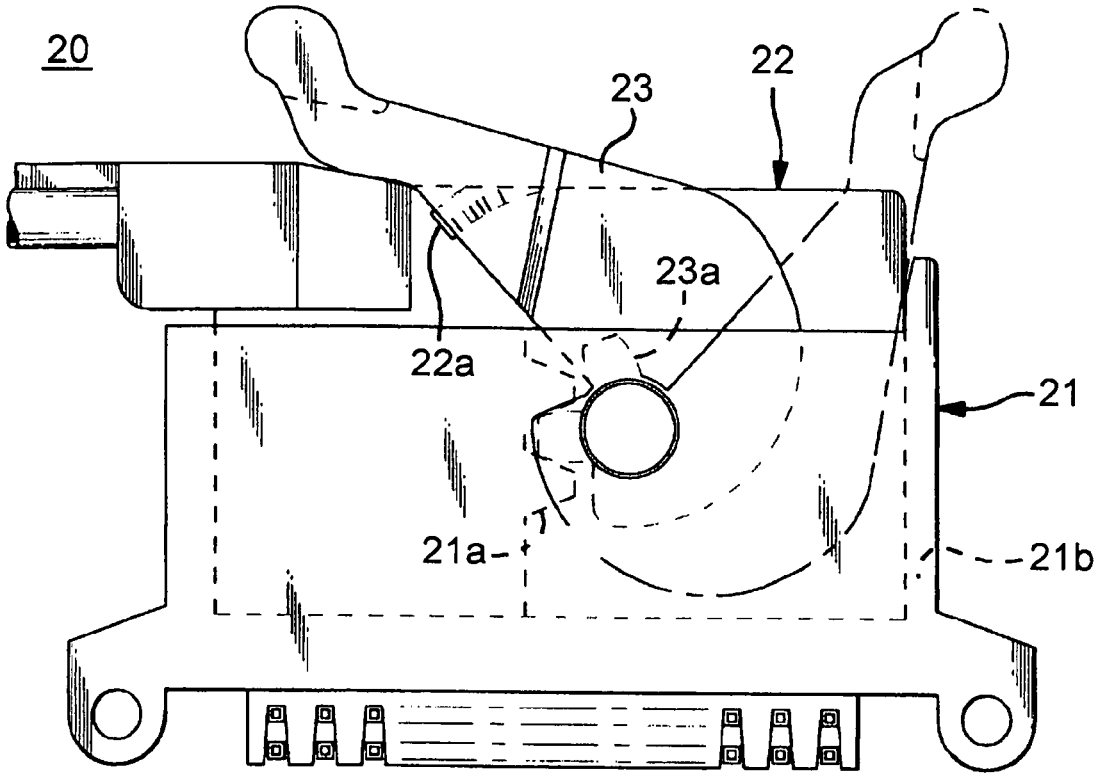
FIG. 6 is a side view of an electric connector according to a related art.
Figure 7:
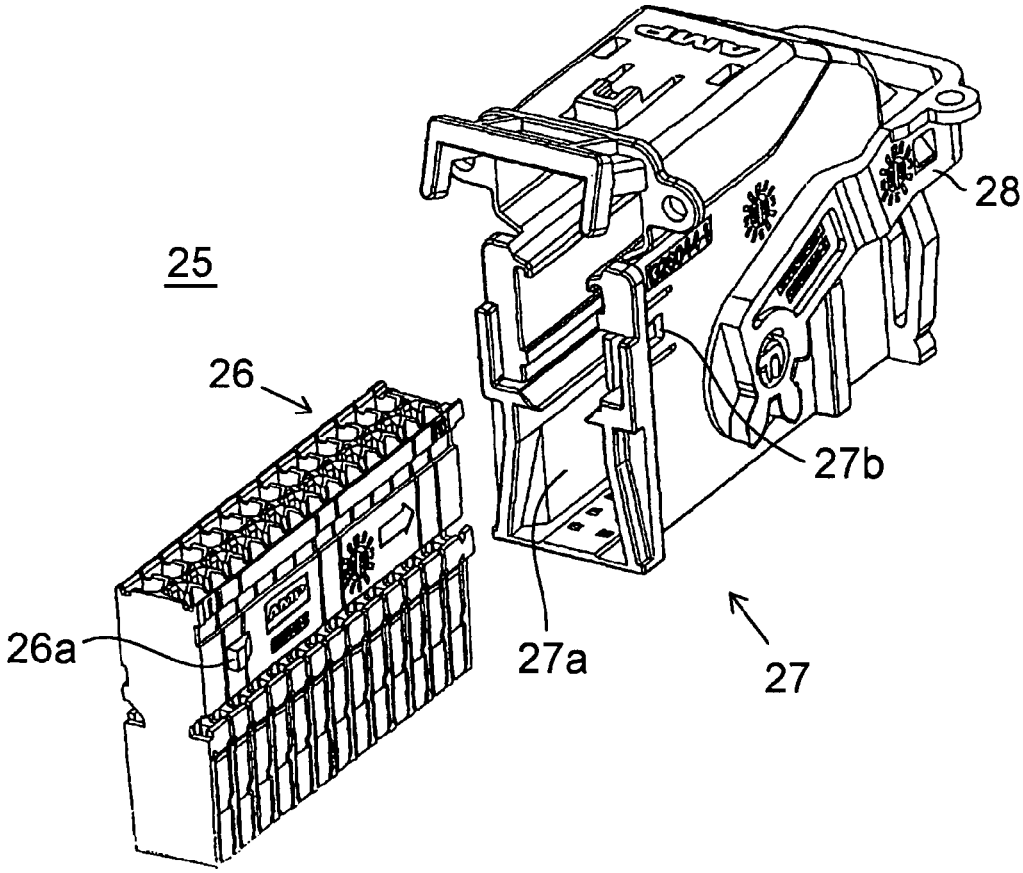
FIG. 7 is an exploded perspective view of an electric connector according to another related art.

The preferred embodiment of the present invention will be explained in detail with reference to the accompanying drawings. FIG. 1 is an exploded perspective view of an electric connector 1 according to an embodiment of the present invention. FIG. 2 is an exploded perspective view of the electric connector 1 of FIG. 1 without an operation lever 16. FIGS. 3A and 3B show the electric connector 1 of FIG. 1 viewed from different angles. FIG. 3A is a side view, and FIG. 3B is a cross-sectional view of the electric connector 1 sectioned by the IIIB-IIIB line of FIG. 3A. FIGS. 4A and 4B show the electric connector 1 in conditions that a connector body 2 is inserted in a housing. FIG. 4A is a side view of the electric connector 1 in a condition that the connector body 2 is partially inserted in the housing. FIG. 4B is a cross-sectional view of the electric connector 1 sectioned by the IVB-IVB line of FIG. 4A. FIGS. 5A, 5B, and 5C show the electric connector 1 in conditions that the connector body 2 is improperly inserted. FIG. 5A is a side view, FIG. 5B is a cross-sectional view of the electric connector 1 sectioned by the VB-VB line of FIG. 5A, and FIG. 5C is a perspective view of the electric connector 1 of FIG. 5A viewed from a different angle.

The electric connector 1 described below is a receptacle-type connector that is to be engaged with another connector as in the electric connector assembly 20 of the related art although the other connector is not shown in the figures.

The electric connector 1 includes the connector body 2 and a connector housing (hereafter referred to as housing) 10. The connector body 2 has contacts housed in a connector body housing 3. The housing 10 has a cavity 12 that is large enough for housing the connector body 2, and an operation lever 16. The connector body 2 is inserted in the cavity 12 of the housing 10.

Referring to FIGS. 1 and 2, the overall shape of the connector body 2 is a narrow rectangular parallelepiped shape. The connector body 2 has the connector body housing 3 and the contacts (not shown) mounted to the connector body housing 3. The connector body housing 3 is made of synthetic resin. The connector body housing 3 has an anterior wall 3*a*, a posterior wall 3*b*, the first wide sidewall 3*c*, the second wide sidewall 3*d*, the first narrow sidewall 3*e*, and the second narrow sidewall 3*f*. The connector body housing 3 has through holes 4 that run from the anterior wall 3*a* through the posterior wall 3*b*. The contacts (not shown) are inserted into the through holes 4 and fixed. The through holes 4 are arranged in multiple lines at certain intervals in the longitudinal direction of the anterior wall 3*a* or the posterior wall 3*b*. The second wide sidewall 3*d* has a hollow race 5 as it approximately divides the second wide sidewall 3*d* in half in the longitudinal direction. Moreover, the second wide sidewall 3*d* has a well 6, whose size is predetermined, between the anterior wall 3*a* and the race 5. The well 6 temporarily holds a small projection 13*a* of a sensing member 13 formed in the housing 10 as shown in FIG. 3B. It is preferable to provide a mark that indicates an inserting direction to the housing 10, such as an arrow, on a surface of the second wide sidewall 3*d*.

The housing 10 is a box-shaped container having a cavity 12, which is large enough for housing the connector body 2, as shown in FIGS. 1 and 2. The housing 10 includes a narrow anterior wall 11*a*, a posterior wall (top wall) 11*b* that opposes the anterior wall 11*a*, the first wide sidewall 11*c*, the second wide sidewall 11*d*, the first narrow sidewall 11*e*, and the second narrow sidewall 11*f*. The first narrow sidewall 11*e* has an opening of the cavity 12. The anterior wall 11*a* has openings 11*a*' at positions corresponding to the through holes 4 of the connector body 2. The anterior wall 11*a* is a joint surface that is to have contact with the other connector.

The first wide sidewall 11*c* and the second wide sidewall 11*d* have the first axis projection $\mathbf{15}_1$ and the second axis projection $\mathbf{15}_2$, respectively. The second axis projection $\mathbf{15}_2$ is formed on the first wide sidewall 11*c*, namely, not shown in FIGS. 1 and 2. The operation lever 16, which will be described later, is attached to the axis projections $\mathbf{15}_1$ and $\mathbf{15}_2$, and rotatably fixed. The second wide sidewall 11*d* has the sensing member 13 about the center. The sensing member 13 is a long rectangular piece that extends from the first narrow sidewall 11*e* to the second narrow sidewall 11*f* on the second wide sidewall 11*d*. The rectangular piece is formed by producing narrow gaps 14 for defining its edges except for the side adjacent to the first narrow sidewall 11*e*. The sensing member 13 has resilience because it is connected to the second wide sidewall 11*d* at one end. A free end 13*b* of the sensing member 13 has a small projection 13*a*, as shown in FIG. 3B. The small projection 13*a* extends from the inner surface of the second wide sidewall 11*d* for a predetermined length inside the cavity 12. The first wide sidewall 11*c* has a small window $\mathbf{11}c_0$ at a position corresponding to the sensing member 13 formed on the second wide sidewall 11*d*. The small window $\mathbf{11}c_0$ is provided for verifying an insertion condition of the connector body 2 by looking at the sidewall of the connector body 2 through the small window $\mathbf{11}c_0$ when the connector body 2 is inserted into the housing 10.

The operation lever 16 is a synthetic resin molding having the first arm $\mathbf{16}_1$ and the second arm $\mathbf{16}_2$. One end of the first arm $\mathbf{16}_1$ and one end of the second arm $\mathbf{16}_2$ are connected with each other via a connecting member $\mathbf{16}_3$. The first and the second arms $\mathbf{16}_1$, $\mathbf{16}_2$ have mounting holes $\mathbf{17}_1$, $\mathbf{17}_2$ at their ends, respectively, such that the axis projections $\mathbf{15}_1$, $\mathbf{15}_2$ are inserted into the mounting holes $\mathbf{17}_1$, $\mathbf{17}_2$. The mounting hole $\mathbf{17}_2$ is formed in the second arm 162 and therefore not shown in FIG. 2. The first arm $\mathbf{16}_1$ has a pinion $\mathbf{18}_1$ at its end. Moreover, the first arm $\mathbf{16}_1$ has a flat portion 16*a* on one of the sidewalls that are orthogonal to the second wide sidewall 11*d* when the operation lever 16 is mounted to the housing 10. The pinion $\mathbf{18}_1$ is engaged with a rack when the electric connector 1 is connected to another connector (not shown). This engagement is made in the same manner as the related art. The connecting member $\mathbf{16}_3$ has a locking member $\mathbf{19}_1$ for securing the operation lever 16 in a position connected with the other connector and not rotating back to its original position. The locking member $\mathbf{19}_1$ is anchored to locking member 11*b*' provided in the housing 10.

A method for inserting the connector body 2 to the housing 10 will be discussed referring to FIGS. 1 through 5C. As shown in FIG. 3, the operation lever 16 is tilted toward the second narrow sidewall 11*f*, and the connector body 2 in which the contacts are mounted is inserted into the cavity 12 of the housing 10. When the connector body 2 is inserted from an opening formed in the first narrow sidewall 11*e* into the cavity 12 of the housing 10, the second wide sidewall 3*d* of the connector body 2 lifts the small projection 13*a* of the sensing member 13 as shown in FIGS. 4A and 4B. As a result, the free end 13*b* of the sensing member 13 rises from the surface of the second wide sidewall 11*d* against the resilience. When the connector body 2 is inserted further into to the housing 10, the small projection 13*a* of the sensing member 13 is fitted into the well 6 of the connector body 2. In this condition, the connector body 2 is completely inserted into the housing 10. When the operation lever 16 is rotated in this condition, the small projection 13*a* of the sensing member 13 is fitted in the well 6. Namely, the small projection 13*a* of the sensing member 13 does not rise from the surface of the second wide sidewall 11*d*. Therefore, the flat portion 16*a* of the first arm $\mathbf{16}_1$ can be rotated without being caught by the sensing member 13. If the anterior wall 11*a* of the housing 10 is engaged with the other connector such that the pinion $\mathbf{18}_1$ of the first arm $\mathbf{16}_1$ is interlocked with a rack (not shown) of the other connector, the other connector is pulled by the anterior wall 11*a* and engaged as the operation lever 16 rotates. As a result, connection between the two connector assemblies is properly made.

At this time, as shown in FIGS. 5A through 5C, the flat portion 16*a* of the operation lever 16 hits the free end 13*b* of the sensing member 13 and the rotation is blocked if the free end 13*b* of the sensing member 13 rises from the surface of the second wide sidewall 11*d*, namely, the connector body 2 is not completely inserted in the housing 10. Thus, the electric connector 1 cannot be connected with the other connector if the connector body 2 is incompletely inserted in the housing 10, namely, the reliability and the safety of the connector connection can be maintained at high level.

What is claimed is:

1. An electric connector including a connector body having a contact, and a connector housing having a cavity and an operation lever, the cavity provided for housing the connector body, the connector body slid into the cavity of the connector housing, and the operation lever rotated for engagement with another connector, the connector housing having a sensing member that is formed in one of sidewalls thereof for detecting an insertion condition of the connector body in the cavity by rising from the sidewall as the connector body is slid into the cavity; and the operation lever hitting the sensing member when the sensing member rises from the sidewall and rotation of the operation lever is blocked.

2. The electric connector according to claim 1, wherein;

the sensing member has a resilient piece that is formed by cutting away a portion of the sidewall of the connector housing, a projection that is formed on an inner surface of a free end of the resilient piece such that the projection extends inwardly in the cavity, and a well that is formed in a portion of a sidewall of the connector body such that the projection is fitted in; and the projection is fitted in the well when the connector body is completely inserted in the cavity of the connector housing.

3. The electric connector according to claim 1, wherein the operation lever has a predetermined length of an arm member, the arm member hitting the sensing member.

4. The electric connector according to claim 3, wherein the operation lever has an engagement portion that is engaged with another connector at an end of the arm member.

* * * * *